United States Patent [19]

Flint et al.

[11] 4,254,364

[45] Mar. 3, 1981

[54] LAMP REGULATOR CIRCUIT FOR ROTARY CAMERA

[75] Inventors: John R. Flint, Barrington; Karavattuveetil G. Rabindran, Morton Grove; Jerry W. Clevenger, Hanover Park, all of Ill.

[73] Assignee: Bell & Howell Company, Chicago, Ill.

[21] Appl. No.: 36,192

[22] Filed: May 4, 1979

[51] Int. Cl.[3] ..... G05F 1/00; H05B 41/39; H05B 41/392

[52] U.S. Cl. ..... 315/311; 315/151; 315/205; 315/DIG. 5; 250/205

[58] Field of Search ..... 315/307, 311, 151, 158, 315/DIG. 5, 205; 250/205; 355/68, 69; 330/107

[56] References Cited

U.S. PATENT DOCUMENTS 3,512,102 5/1970 Kubach ..... 330/107

3,670,202 6/1972 Paine et al. ..... 315/307

*Primary Examiner*—Alfred E. Smith
*Assistant Examiner*—Thomas P. O'Hare
*Attorney, Agent, or Firm*—Alan B. Samlan; John H. Moore

[57] ABSTRACT

A flow, or rotary type, microfilm recording apparatus for filming documents having a document transport means to move documents past an aperture area. An alternating current powered fluorescent lamp is employed for illuminating the documents in the aperture area. In order to adjust, set and maintain a substantially constant level of illumination in the aperture area and to reduce flicker, a lamp regulator circuit is provided which includes a shunted rectifier load circuit and a variable current device responsive to the illumination from the fluorescent lamp for varying the voltage drop across the shunt in accordance with the illumination.

5 Claims, 3 Drawing Figures

LAMP REGULATOR CIRCUIT FOR ROTARY CAMERA

BACKGROUND OF THE INVENTION

This invention relates to a flow, or rotary type of photographic recorder for optically recording the images of documents in greatly reduced size upon film while those documents are continuously transported past an aperture area, and relates specifically to an improved circuit for maintaining the illumination constant in the aperture area.

In a rotary recorder the images of documents are optically recorded on rolls of photographic film. The documents are caused to move at an essentially constant velocity through the photographic area which includes a fixed slit aperture and an illumination source. As each document moves through the recorder, it trips a control switch which starts the film moving and opens the camera shutter so that as the document passes the aperture the image of the illuminated document is reflected by a series of mirrors into the camera lens and onto the film which is moving at a speed proportional to the speed of the document. Because the movement of film and document is so proportioned, the image of the document appears stationary, or essentially so, on the surface of the film.

As the moving documents pass through the aperture area the only other variable is the illumination on the documents. Obviously if the illumination changes as a document moves past the aperture the brightness of the recorded image will change with it. Hence it is desirable to be able to adjust the illumination level for best recording and to thereafter maintain the illumination level for line voltage variations as well as lamp life. The problem of a constant illumination level is particularly complicated where a lamp driven by an alternating current source is chosen such as a fluorescent bulb. There, in order to regulate the alternating current source cross over distortion becomes a problem which introduces a flicker in the illumination and causes a line or dash spot to appear across the recording film.

SUMMARY OF THE INVENTION

It is an object of the invention to provide a voltage regulator circuit for a fluorescent lamp of the type including a parallel ballast in series with a variable impedance connected across the alternating current source, which variable impedance changes in accordance with the illumination from the fluorescent lamp and thereby corrects any variations in the voltage drop across the ballast and the illumination level of the lamp.

A specific object of the invention is to provide a voltage regulator circuit for a fluorescent lamp wherein the ballast is connected in series with a shunted rectifier and wherein the voltage drop across the rectifier shunt is varied in accordance with changes in the level of illumination from the lamp thereby to effect a change in the voltage drop across the ballast.

A yet more specific object of the invention is to provide a voltage regulator for a fluorescent lamp wherein the ballast is connected in series with a shunted rectifier, and wherein the voltage drop across the rectifier shunt is varied directly in accordance with the change in illumination level thereby to vary inversely the voltage drop across the ballast, and wherein the voltage drop across the rectifier shunt varies with the voltage of the alternating current source and is connected to compensate for both extreme voltage peaks and cross-over voltage drops.

DESCRIPTION OF THE PREFERRED EMBODIMENT

Figure 1:
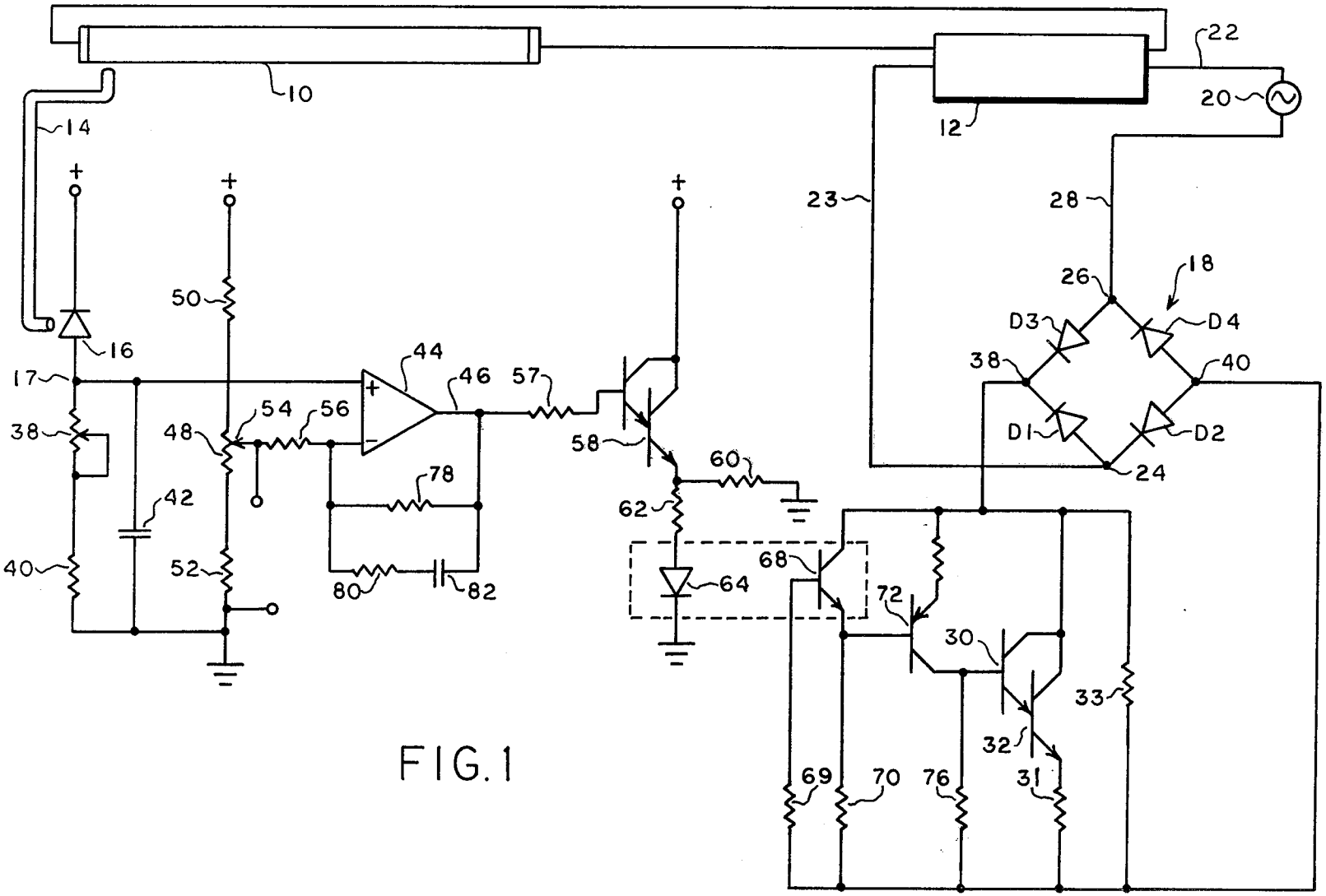
FIG. 1 is a circuit schematic of the voltage regulator circuit as connected in a feedback system with the fluorescent lamp source.

Referring now to FIG. 1, there is shown a conventional fluorescent lamp 10, the light output of which is employed to illuminate a succession of documents which are to be sequentially photographed. The lamp 10 is energized by a conventional ballast 12.

To sense the light output of the lamp 10, a fiber optic cable 14 carries a portion of the lamp's light to a photosensitive diode 16 for generating at node 17 a signal indicative of light output. That signal is processed in a feedback control system for regulating the voltage applied to the ballast 12, thereby also regulating the amount of light generated by the lamp.

The lamp 10 is electrically connected to the control system by including the lamp's ballast 12 in series with a conventional diode bridge rectifier 18 and a 120 volt, 60 hertz A.C. source 20. Specifically, one end of the ballast 12 is coupled via a lead 22 to one side of the source 20. The opposite end of the ballast is coupled to a junction 24 between diodes D1 and D2 of the rectifier 18 via a lead 23. Another paid of diodes D3 and D4 are coupled to diodes D1 and D2 in a conventional bridge arrangement. A junction 26 between the diodes D2 and D4 is coupled to the other side of the source 20 via a lead 28. In this arrangement, a portion of the voltage from the source 20 is dropped across the ballast 12 and the remainder is dropped across the rectifier 18.

To vary the voltage dropped across the rectifier 18, a pair of transistors 30 and 32, coupled together in a darlington configuration, in conjunction with an emitter load resistor 31 and a parallel load resistor 33 are connected via leads 34 and 36 to junctions 38 and 40 of the rectifier 18. Thus, the transistors 30 and 32 essentially shunt the rectifier 18 so that, by varying their level of conduction, the transistors 30 and 32 vary the amount of voltage dropped across the rectifier 18. A corresponding variation occurs in the amount of voltage dropped across the ballast 12, and the light output from the lamp 10 undergoes a corresponding change. The remainder of the feedback system varies the level of conduction of the transistors 30 and 32 in response to the signal generated by the diode 16.

At this juncture it should be noted that the light output from the lamp 10 follows the waveshape of the 60 hertz voltage across the ballast 12, except for some integrating effect caused by the usual phosphor coating on the lamp. Hence, any distortions present in the voltage waveform across the ballast give rise to undesirable variations in light output. One source of such distortion is the rectifier 18.

Specifically, the rectifier 18 and the transistors 30 and 32 tend to develop a so-called "cross-over" distortion in the voltage across the ballast 12. Such distortion occurs because of the inability of the diodes D1–D4 and the transistors 30 and 32 to accurately respond to the A.C. line signal as that signal changes polarities.

Figure 2:
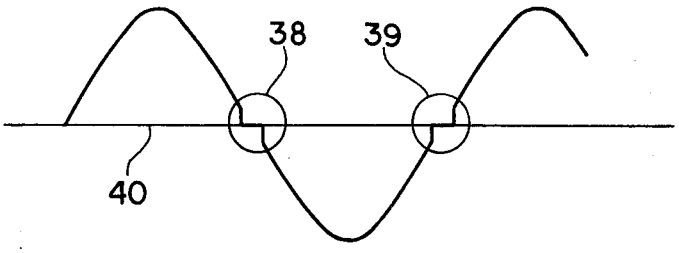
FIG. 2 shows the distorted and uncorrected voltage from the alternating current source across the fluorescent lamp ballast.

Referring to FIG. 2, there is shown a waveform depicting the uncorrected and distorted voltage across the ballast 12. As shown, the waveform becomes distorted at 38 and 39 where the signal crosses the cross-over line 40. Left uncorrected, the voltage across the ballast 12 would cause an unwanted incremental variation in the output of the lamp. However, the feedback network described below reduces the effect of the cross-over distortion and controls the voltage across the ballast 12 so as to develop a substantially constant light output.

Referring now to the diode 16, the cathode thereof is connected to a positive 12 volt supply, and the node is coupled to ground through a variable resistor 38 in series with a fixed resistor 40. The current developed in response to light incident on the diode 16 flows through the resistors 38 and 40 to develop a control signal at the node 17. The amplitude of the control signal is adjustable by adjustment of the resistor 38.

The control signal is coupled to one side of a grounded capacitor 42 and to the positive input terminal of a difference amplifier 44. The negative input terminal of the amplifier 44 receives a reference voltage indicative of the amount of light which the lamp 10 is to generate. Responsive to a difference between its two input signals, the amplifier 44 generates an error signal at its output lead 46 for changing the light output of the lamp in a direction which reduces the difference between the reference voltage and the control voltage.

The reference voltage is generated by a voltage divider network including a variable resistor 48 which is coupled to the supply voltage via a fixed resistor 50 and to ground by another fixed resistor 52. A wiper arm 54 on the resistor 48 is coupled via a resistor 56 to the negative input terminal of the amplifier 44. Hence, varying the position of the wiper arm 54 varies the amplitude of the reference voltage.

The error signal is coupled from the output of the amplifier 44 via lead 46 and fixed resistor 57 to a darlington-connected emitter follower 58, the emitter of which is coupled to ground through a resistor 60. In parallel with the resistor 60 is a series combination of a resistor 62 and a light-emissive diode 64. The light generated by the diode 64 is proportional to the current through the resistor 62, and proportional, therefore, to the amplitude of the error signal.

As indicated by the dashed line 66, the diode 64 is part of an optical isolator, the function of which is to isolate the circuitry "upstream" of the isolator from the A.C. power line "downstream" therefrom. The signal-receiving part of the isolator is a photo-sensitive transistor 68 which develops across its emitter resistor 70 a voltage which is proportional to the light generated by the diode 64. Accordingly, the voltage across the resistor 70 is proportional to the error signal.

A PNP type transistor 72 having an emitter resistor 74 and collector resistor 76 receives the voltage from the emitter of the transistor 68, inverts it, and applies it to the base of the transistor 30. Thus, the conduction level of the transistors 30 and 32 is controlled as a function of the error signal.

In operation, a decrease in the level of light generated by the lamp 10 results in a corresponding decrease in the current through the diode 16. Thus, the control voltage at node 17 decreases. In response, the error signal developed by the amplifier 44 changes in a negative direction, thereby causing the emitter follower 58 to reduce its conduction. As a result, the diode 64 emits less light, the voltage at the emitter of the transistor 68 is reduced, and the voltage at the base of the transistor 30 is increased. Consequently, the transistors 30 and 32 conduct harder and the total voltage drop across paralleL load resistors 31 and 33 and hence the voltage drop across the rectifier 18 is reduced. That reduction in voltage is matched by a corresponding increase in voltage across the ballast 12, thereby increasing the light generated by the lamp 10. Thus, because of the feedback system, the initial decrease in the output of the lamp is followed immediately by a compensating increase in the voltage applied to the ballast. Similarly, any increase in the output of the lamp is followed by a compensating decrease in the voltage applied to the ballast.

As stated above, it is also desirable to compensate for cross-over distortion occurring in the voltage across the ballast 16. Toward this end, the feedback system is provided with a slew rate that is greater than conventional and fast enough to respond to incremental changes in light output due to 60 hertz rate changes in the ballast voltage. As a result, the error voltage is capable of compensating for the distortion in the ballast voltage.

To achieve the desired slew rate, the feedback system includes a resistor 78 coupling the error signal to the negative input terminal of the amplifier 44. In addition, another resistor 80 is coupled in series with a capacitor 82, the combination being connected in parallel with the resistor 78. With this arrangement, the gain of the amplifier 44 at low frequencies is controlled by the value of the resistor 78, and its gain at higher frequencies is controlled by the resistor 80 and the capacitor 82.

Figure 3:
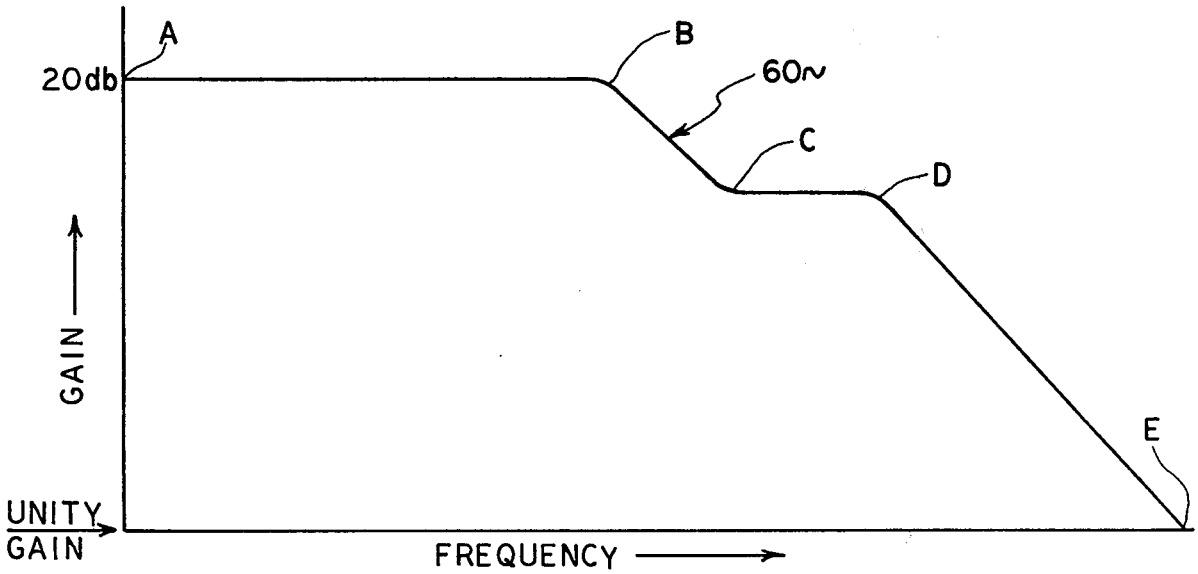
FIG. 3 is a plot of system gain versus frequency for the feedback system of FIG. 1.

Referring now to FIG. 3, a plot of system gain versus frequency is shown whereby the system of FIG. 1 is rendered stable and yet responsive to light variations at a 60 hertz rate. As shown, the gain of the system is about 20 db (decibels) and remains substantially constant between points A and B, the low frequency range. The value of this low frequency gain is determined substantially by the value of the resistor 78.

At point B on the plot preferably about 0.8 hertz, the gain starts decreasing at a rate of 6 db per octave. Point B is determined by the values of the resistor 78 and the capacitor 82. As shown on the plot, the gain of the system at 60 hertz is substantially larger than it is in conventional feedback systems for regulating 60 hertz voltage, thus enabling the system to compensate for ballast voltage distortions occuring at a 60 hertz rate.

As the gain decreases with frequency, the resistor 80 and the capacitor 82 cause the gain to level off at point C which is preferably about 800 hertz, as determined by the values of resistor 80 and the capacitor 82. As a result of the effect of the resistor 80 and the capacitor 82, a positive phase shift is introduced to compensate for the negative phase shift introduced at point B. The change in gain thus achieved permits placing point B at a frequency which is high enough to provide substantial gain at 60 hertz without causing instability in the system.

From point C to point D, the gain remains substantially constant and lower than the low frequency gain by a factor corresponding to the difference between the values of the resistors 78 and 80. In practice, a 60 db gain reduction between points B and C has been found to be satisfactory.

Finally, the gain of the system drops off again at point D and reaches unity gain at a rate of about 6 db per octave, due to the effect of the capacitor 42 interacting with the resistance at the node 17.

By virtue of the frequency response illustrated in FIG. 3, the feedback system is stable and yet responsive enough to 60 hertz variations in the light from lamp 10 to compensate for those variations. In practice, the lamp 10 has been found to maintain a light output which varies by less than about 5 percent.

To set up the system of FIG. 1, it is preferred to set the resistor 48 to its end position toward resistor 50 at which a maximum reference voltage is produced. Where the lamp 10 is used as a source of illumination for a camera, such a setting of the resistor 48 is effectively a maximum exposure setting.

The voltage across the ballast 12 is then measured and the resistor 38 is adjusted until the measured voltage equals about 95 volts. This procedure compensates for losses throughout the feedback system, particularly the optical isolator, and the diode 16. The resistor 48 can then be adjusted to obtain the desired exposure setting which the system will then maintain.

The system described about has a number of advantages over conventional lamp regulators, both A.C. and D.C. For example, fluorescent lamps energized by a regulated D.C. voltage tend to darken quickly, particularly at their ends. Moreover, D.C. regulators are generally more expensive, due in part to the cost of establishing a high enough D.C. voltage to start and sustain energization of the lamp.

A.C. regulators, on the other hand, can work as described above in cooperation with a conventional, low cost ballast. The ballast provides the high starting voltage required and provides some regulation of the A.C. voltage.

By providing the regulator with the high slew rate as described above, the regulator not only compensates for light variations due to ballast heating, lamp aging and changes in the A.C. line voltage, it also compensates for higher frequency, 60 hertz distortions in the voltage supplied to the ballast.

The regulator described herein is also useful in regulating a pair of fluorescent lamps which are energized by a conventional two-lamp ballast. To the extent that both lamps age uniformly, long term variations in light output are eliminated. Short term variations in light output are eliminated as effectively as in a one lamp system.

Although the invention has been described in terms of a specific preferred embodiment, it will be obvious to those skilled in the art that many alterations and variations thereto may be made without departing from the invention. Accordingly, all such alterations and modifications are intended to be within the spirit and scope of the invention as defined by the appended claims.

What is claimed is:

1. A voltage regulator for regulating the magnitude of voltage an electrical source of power applies to a ballast of a fluorescent lamp, comprising:

a rectifier bridge circuit having a pair of input bridge junctions and a pair of output bridge junctions;

means for connecting the ballast circuit, the source of power, and the pair of input bridge junctions in series;

a variably conducting shunt circuit connected to the second pair of bridge junctions, the shunt circuit having a relatively high impedance leg connected across the pair of output bridge junctions and a relatively low impedance leg connected across the pair of output bridge junctions;

a variable current device connected into the relatively low impedance leg of the shunt circuit; and means for controlling the flow of current through said variable current device inversely in accordance with the intensity of illumination from the fluorescent lamp.

2. A voltage regulator as set forth in claim 1 wherein the means for controlling the flow of current through said variable current device includes:

means for generating a signal indicating the intensity of light from the fluorescent lamp;

a differential ammplifier having a first input, a second input, and an output;

a first voltage source for applying a reference voltage to the first input;

means for applying the signal indicating the intensity of light to the second input; and a signal inverter for changing the flow of current through the variable current device inversely with the signal at the output of the differential amplifier.

3. A voltage regulator as set forth in claim 2 further comprising means for damping the higher frequency components of voltage changes resulting from changes in the intensity of illumination of the fluorescent lamp.

4. A voltage regulator as set forth in claim 3 wherein the means for damping the higher frequency components includes a feedback circuit from the output to the first input of the differential amplifier for regulating the gain of the amplifier.

5. A voltage regulator as set forth in claim 4 wherein the slew rate of the feedback system is selected to be sufficiently fast to respond to 60 hertz rate changes in the intensity of the illumination of the fluorescent lamp.

* * * * *